United States Patent [19]

Johnson

[11] 4,170,246

[45] Oct. 9, 1979

[54] PILOT OPERATOR VALVE

[75] Inventor: Gary Johnson, Racine, Wis.

[73] Assignee: Sta-Rite Industries, Inc., Racine, Wis.

[21] Appl. No.: 799,682

[22] Filed: May 23, 1977

[51] Int. Cl.[2] ..... F15B 11/08; F15B 13/043

[52] U.S. Cl. ..... 137/596.12; 137/596.2; 91/420

[58] Field of Search ..... 137/596.12, 596.2; 91/413, 420

[56] References Cited

U.S. PATENT DOCUMENTS

| | | | |
|---|---|---|---|
| 2,608,824 | 9/1952 | Kirkham . | |
| 2,621,478 | 12/1952 | Bridwell et al. . | |
| 3,171,496 | 3/1965 | Nelson . | |
| 3,411,536 | 11/1968 | Tennis . | |
| 3,472,261 | 10/1969 | Brannon | 91/420 |
| 3,543,647 | 12/1970 | Hall et al. | 91/420 |
| 3,866,419 | 2/1975 | Paul . | |
| 3,908,515 | 9/1975 | Johnson | 91/420 |
| 3,929,159 | 12/1975 | McAvoy | 91/420 |
| 4,039,085 | 8/1977 | Livengood | 91/420 |

*Primary Examiner*—Martin P. Schwadron
*Assistant Examiner*—A. Michael Chambers
*Attorney, Agent, or Firm*—Mason, Kolehmainen, Rathburn & Wyss

[57] ABSTRACT

A valve for directing pressurized fluid includes a fluid directional element for controlling fluid flow to a work member and a motor, and a one way flow member for controlling fluid flow to the work member. The one way flow member is actuated by a pilot operated actuator. The pilot operated actuator includes surfaces against which fluid pressure acts to move the actuator from a first position to a position actuating the one way flow member to allow flow to the work member. The valve further includes a capturing mechanism to hold the pilot operated actuator in its actuating position to hold the one way flow member in the actuated position allowing flow to and from the work member.

9 Claims, 4 Drawing Figures

PILOT OPERATOR VALVE

BACKGROUND OF THE INVENTION

A. Field of the Invention

The present invention relates to a valve for directing flow to a work member and a fluid motor to control the operation of each.

B. Description of the Prior Art

Typical lawn mowers employed to mow areas such as golf greens include mower reels that are raised and lowered by a hydraulic operated work member such as a hydraulic cylinder. A valve directs pressurized fluid to the work member and to the motor turning the reels. In this manner, the valve operates to control the lifting of the reels off the ground and the rotation of the reel motor as the vehicle is propelled from one green to another. In addition, for safety reasons as the reels are being lowered or raised, the valve is actuated such that the motor is not operated.

In addition, it is also desirable that while the reels are in the lowered position to mow the green, the work member mechanism is in a "float" condition such that as the reels engage bumps or irregularities in the terrain, they may freely rise and fall or "float" with the terrain. Accordingly, the hydraulic fluid must be able to flow to and from the work member.

Prior art valves employed to control the fluid to the work member and the reel motor use complex mechanisms including several components. Furthermore, complicated porting including several valve elements are necessary to provide the floating effect.

SUMMARY OF THE INVENTION

An object of the present invention is to provide a new and improved valve for directing flow to a work member and a fluid motor.

Another object of the present invention is to provide a new and improved valve for selectively directing fluid to the work member used to lift the reels of a grass mower and to the fluid motor that powers the reels.

Briefly, the present invention is directed to a new and improved valve that may be employed for selectively controlling the direction of fluid flow to a work member and to a fluid actuator such as a motor. The valve is coupled to a source of pressurized fluid and is in fluid communication through a first port to the work member and through a second port to the fluid motor. The valve also includes a selectively operable, fluid directional control member that controls the fluid flow through the ports. Flow through the first port is also controlled by a one way valve.

Operation of the one way valve is accomplished by a pilot actuated member. The pilot actuated member includes first and second pressure surfaces that are in fluid communication with the pressurized fluid source. This communication of pilot fluid is controlled by the directional control element.

Also included in the valve is a capturing mechanism that captures the pilot actuated member in a position maintaining the one way valve in an open position.

BRIEF DESCRIPTION OF THE DRAWINGS

The present invention together with the above and other objects and advantages will best appear from the following detailed description of an illustrative embodiment of the invention shown in the accompanying drawings, wherein.

DETAILED DESCRIPTION OF A PREFERRED EMBODIMENT

Figure 1:
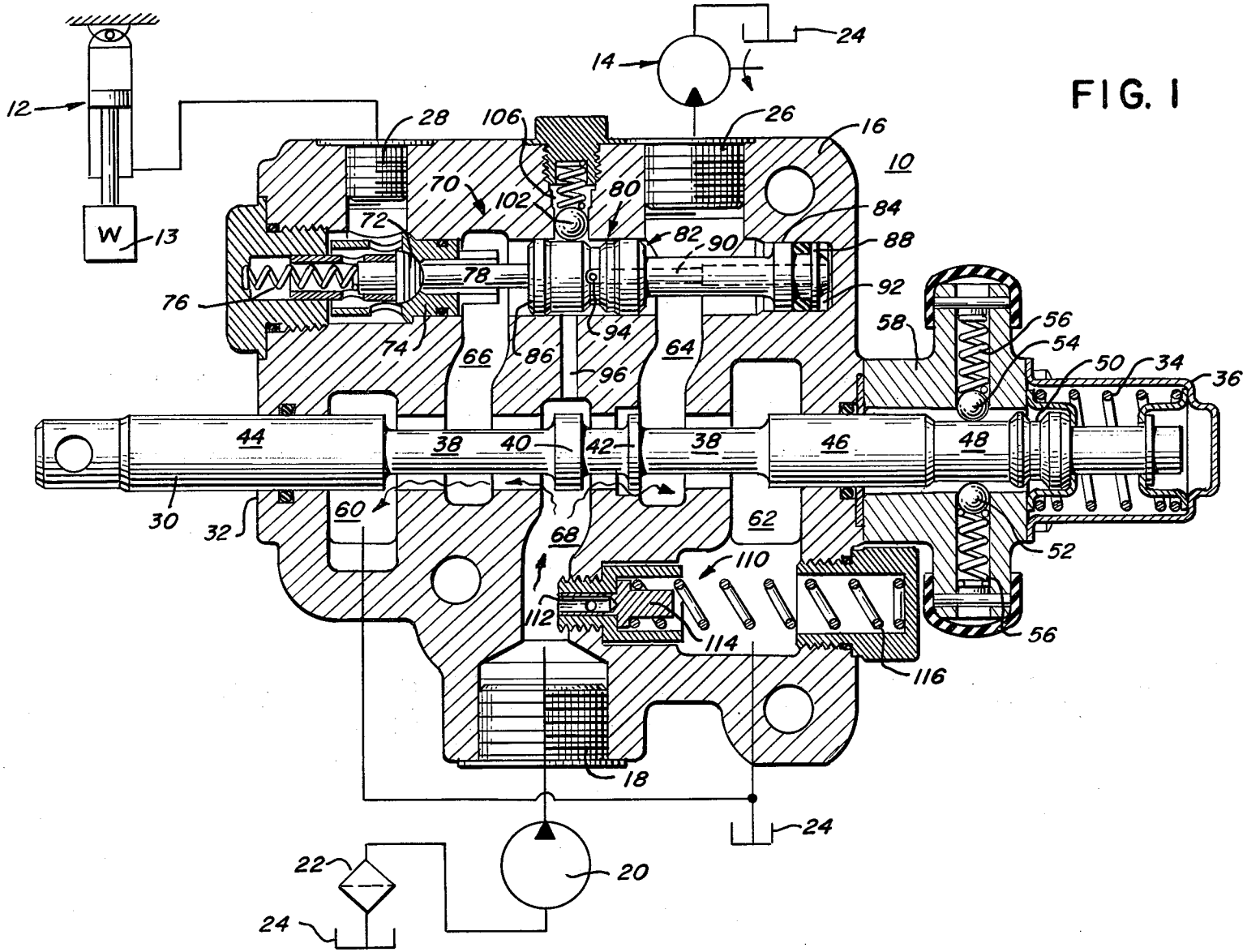
FIG. 1 is a schematic illustration of a fluid system incorporating a valve constructed in accordance with the present invention and in the neutral position.

Having reference now to the drawings and initially to FIG. 1, there is illustrated a four-position valve generally designated by the reference numeral 10. The valve 10 may be employed to operate a single acting cylinder generally designated by the reference numeral 12 and a hydraulic motor designated by the numeral 14. One example of an employment of the valve 10 is in a reel mower of the type for mowing greens on a golf course. The motor 14 would be employed to power the reels and the cylinder 12 corresponds to the cylinder for lifting and lowering the reels 13 relative to the greens.

The valve 10 includes a housing 16 with three fluid ports. The first port 18 is adapted to be coupled to a hydraulic pump 20 that supplies pressurized fluid to the valve 10. The pump 20 is coupled through a filter 22 to a reservoir 24 of hydraulic fluid. The housing 16 includes a second port 26 in fluid communication with the motor 14. The motor 14 is also in fluid communication with the reservoir 24. The third port 28 is in fluid communication with the hydraulic cylinder 12.

To control fluid flow through the valve 10 from the inlet 18 to the outlets 26 and 28, a main spool 30 is slideably mounted within an elongated bore 32 in the housing 16. The spool 30 may be manually operated by the operator of the mower.

The spool 30 is biased to a neutral position (FIG. 1) by a spring 34 coupled to the end of the spool 30 and mounted within a spring housing 36. The spool 30 includes a narrowed portion 38 that defines a first 40 and a second 42 land thereon. In addition, the spool includes opposite end lands 44 and 46. A second reduced portion 48 adjacent to the land 46 defines a detent portion 50 that upon axial movement of the spool 30, is engaged by biased ball detents 52 and 54 to lock the spool 30 in a desired position. The ball detents 52 and 54 are biased into engagement with the spool 30 by springs 56 that are mounted within a detent housing 58. The detent housing 58 is secured to the valve housing 16, and the spring housing 36, in turn, is secured to the detent housing 58.

The spool 30 may be axially moved within the housing 16 to direct fluid flow from the pump 20 through the coring or passages within the valve housing 16 to the outlets 26 and 28. More specifically, the housing 16 includes first 60 and second 62 cores that are in fluid communication with the bore 32 and the tank or reservoir 24. In addition, associated with the outlet 26 is a core 64 in fluid communication with the bore 32. Further, in association with the outlet 28, the housing 16 includes a core 66 also in fluid communication with the bore 32. The inlet 18 includes a core 68 in fluid communication with the bore 32.

In the neutral position of the valve 10 (FIG. 1), the lands 40 and 42 are positioned within the cores 64 and 68 such that pressurized fluid introduced into the inlet 18 flows through the core 68 and along the bore 32 to the cores 60 and 62 wherein the pressurized fluid is returned to the reservoir 24. In this manner, pressurized fluid does not flow to the motor 14 or the cylinder 12.

Control of the fluid to the outlet 28 is also controlled by a pilot operated detented check valve generally designated by the reference numeral 70. The check valve 70 includes a spring biased poppet valve 72 that is biased into a valve seat 74 by a spring 76 mounted within the housing 16. The poppet valve 72 also includes an integral tubular extension 78 that abuts the forward end of a pilot operated spool valve 80. The pilot spool 80 is slideably positioned within first 82 and second 84 bores defined within the housing 16. The poppet valve 72 may be moved out of its seat 74 under the influence of pressurized fluid introduced into core 66 or under the influence of the pilot spool 80 through its engagement with the tubular extension 78.

The pilot spool 80 includes a first end 86 of a first cross-sectional area and a second end 88 of a second cross-sectional area that is smaller than the cross-sectional area of the end 86. In addition, the pilot spool 80 includes an axially extending internal passage 90 that at one end is in fluid communication with a chamber 92 defined between the end of the bore 84 and the end 88 of the spool 80. The inlet 94 of the passage or conduit 90 is in fluid communication with the bore 82 that in turn is in fluid communication with a pilot fluid passage 96. The passage 96 is also in fluid communication with the bore 32.

Accordingly, the position of the pilot spool 80 within the bores 82 and 84 may be varied through the introduction of pressurized fluid to the passage 96. More specifically, if pressurized fluid is introduced to the passage 96, it flows through the passage 90 to the chamber 92 resulting in a shift of the pilot spool 80 within the bores 82 and 84. In the neutral position of the valve 10, however, no pressurized fluid is introduced to the passage 96 since the fluid is vented to the cores 60 and 62. Consequently, the pilot spool 80 is biased to its rightmost position as illustrated in FIG. 1 under the influence of the spring 76 and the poppet valve 72 is positioned in the seat 74. In this position, fluid may not flow out of the cylinder 12 and the reels 13 are locked into the selected position.

Figure 2:
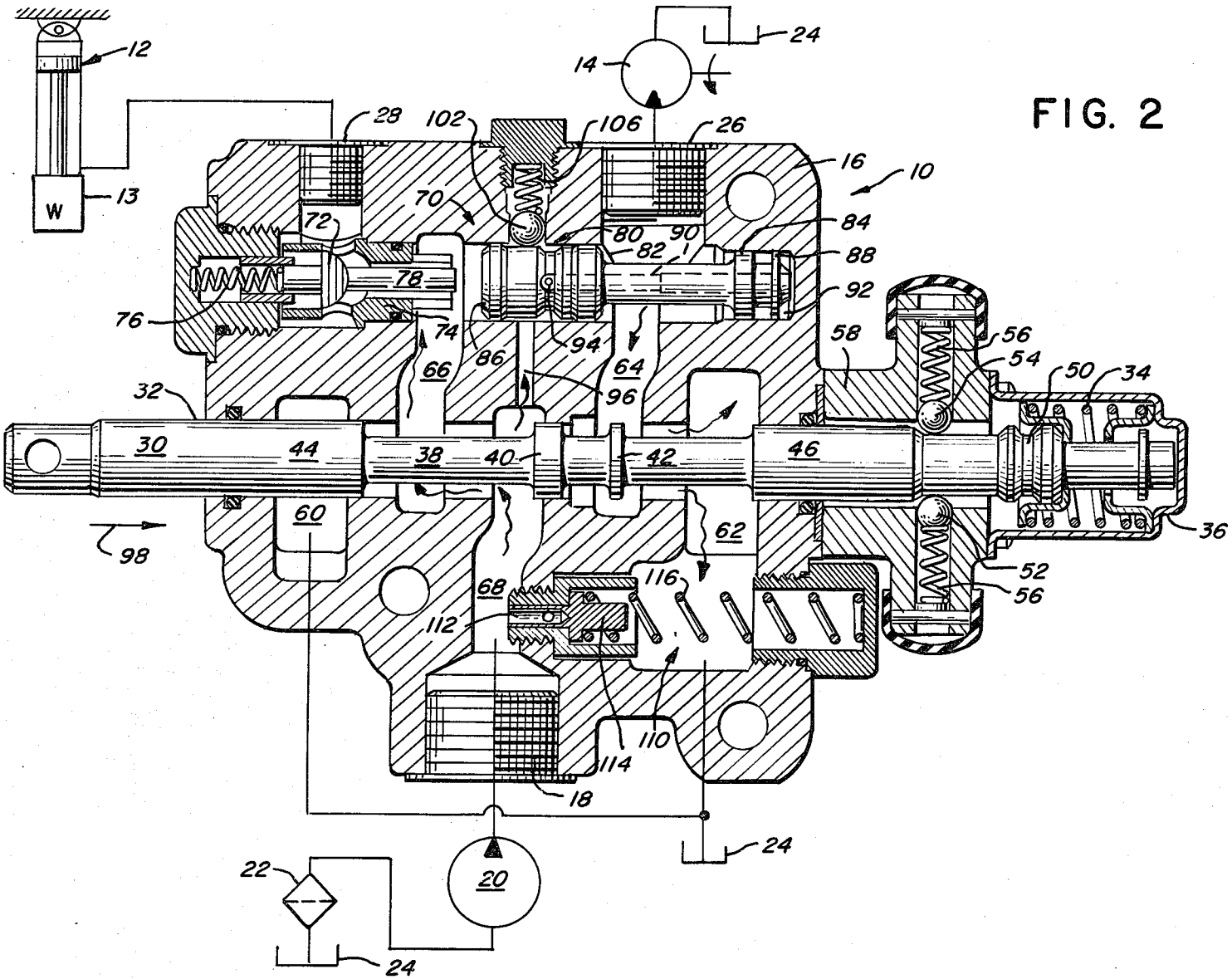
FIG. 2 is an illustration similar to FIG. 1 with the valve in the work member actuation position.

Having reference now to FIG. 2, if it is desired to raise the mower reels 13, the main spool 30 is shifted in the direction of the arrow 98 against the bias of the spring 34. In this position land 40 is in a sealing position within the bore 32 whereas land 42 is positioned within core 64. The land 44 is also sealingly positioned within the bore 32 and blocks fluid flow to the core 60 and thus to the tank 24.

In this position of the valve 10, pressurized fluid from the pump 20 flows through the core 68 along the bore 32 and through the core 66. The fluid pressure acts against the poppet valve 72 with sufficient pressure to shift the poppet valve 72 out of its seat 74 allowing fluid flow across the poppet valve 72, through the outlet 28 to the cylinder 12. The introduction of pressurized fluid to the cylinder 12 lifts the reels 13 off of the ground.

Simultaneously, fluid pressure is also introduced against end 86 of the pilot spool 80 and also to the end 88 through the passages 96 and 90. As a result of the larger area of the end 86 relative to the end 88, however, the pilot spool 80 is not shifted within the bores 82 and 84.

In addition, in this position of the spool 30, fluid may flow from the motor 14 through the core 64 and along the bore 32 to core 62 and the tank 24. Thus the motor 14 is not powered by pressurized fluid and the reels 13 are not operated in the raised position.

During the operation of the mower, it is desired to have the reels 13 positioned on the ground or green while the motor 14 is operated by pressurized fluid to power the reels 13. Due to the uneven nature of greens or similar type surfaces and the bumps that may be experienced by the mower, however, it is not desired that the reels 13 be held in a rigid position but rather be allowed to move freely with the contour of the ground. This condition is termed the float condition whereby the reels 13 float relative to the cylinder 12 to move with the contour of the ground.

Figure 3:
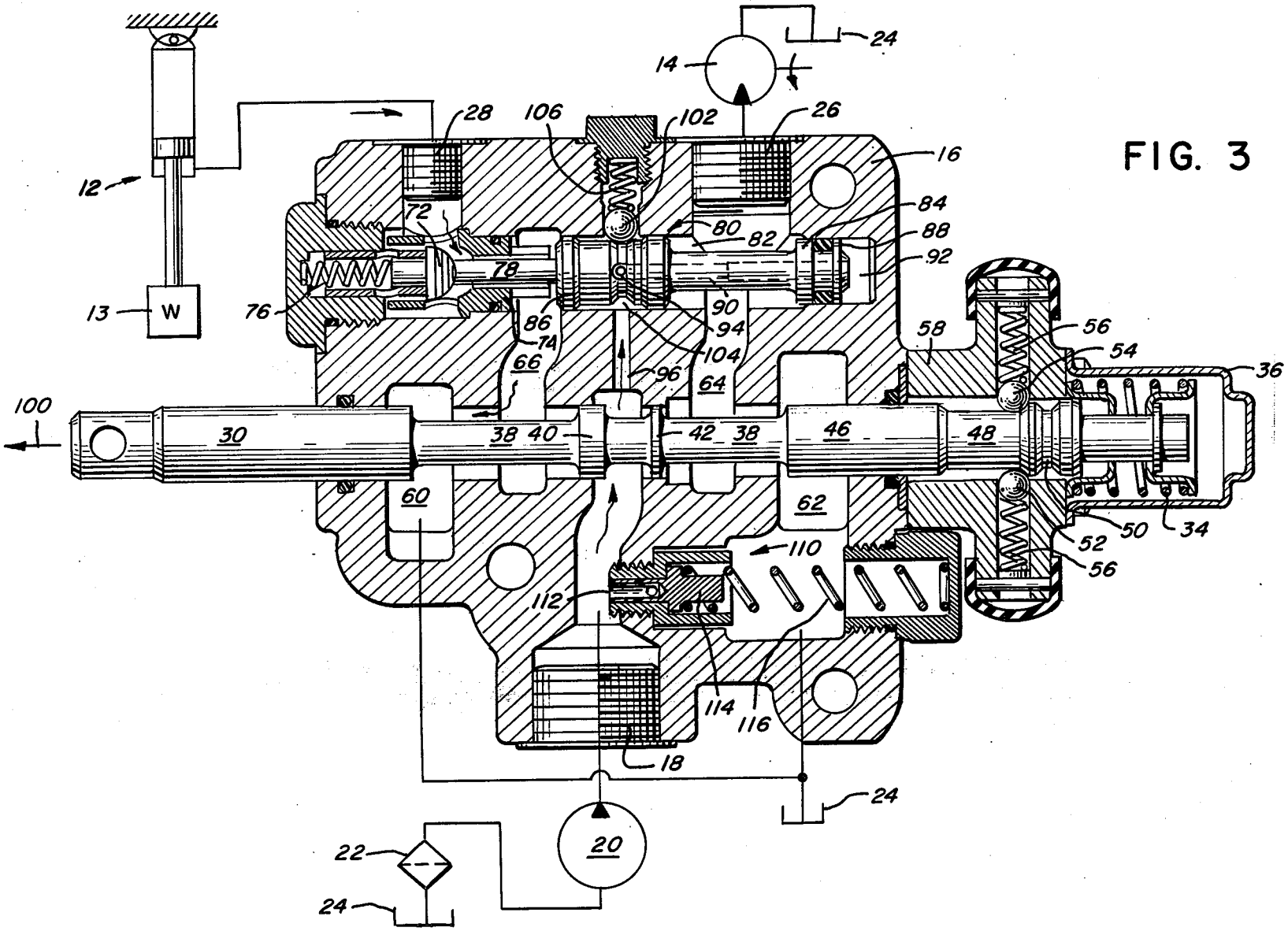
FIG. 3 is an illustration similar to FIG. 1 with the valve in the float engaging position.

The float mode of operation may be accomplished by moving the main spool 30 in the direction indicated by the arrow 100 (FIG. 3) until the lands 40 and 42 are both in a sealing position within the bore 32. In this position hydraulic fluid from the pump 20 is prevented from flowing along the bore 32 and is introduced under full pressure to passage 96.

Pressurized fluid from passage 96 flows along the passage 90 to the chamber 92 and interacts against the end 88 of the pilot spool 80. This pressure is sufficient to overcome the bias of the spring 76 causing the pilot spool 80 to shift within the bores 82 and 84. Through the interaction of the spool 80 with the tubular extension 78 the poppet valve 72 is moved out of its seat 74. In this position, fluid may flow from the cylinder 12 through the outlet 28 and the core 66 to the core 60 and then to the tank 24. This allows the lowering of the reels 13.

As a result of the employment of the pilot spool 80, the reels 13 may be lowered while at the same time the fluid does not flow to the motor 14 due to the land 42 and the reels 13 are not operated. This provides a significant safety feature. In addition, pressurized fluid to the core 66 is prevented by the land 40 allowing free fluid flow in the cores 66 and 60.

In the float position of the pilot spool 80, the pilot spool 80 is held by a ball detent 102 interacting with a reduced portion 104 defined on the pilot spool 80. The ball detent 102 is biased into the reduced portion 104 by a spring 106. Once in this position, the interaction of the ball detent 102 with the pilot spool 80 will hold the pilot spool 80 thereby holding the poppet valve 72 out of its seat allowing the reels 13 to float even though pressurized fluid is no longer introduced to the chamber 92.

Figure 4:
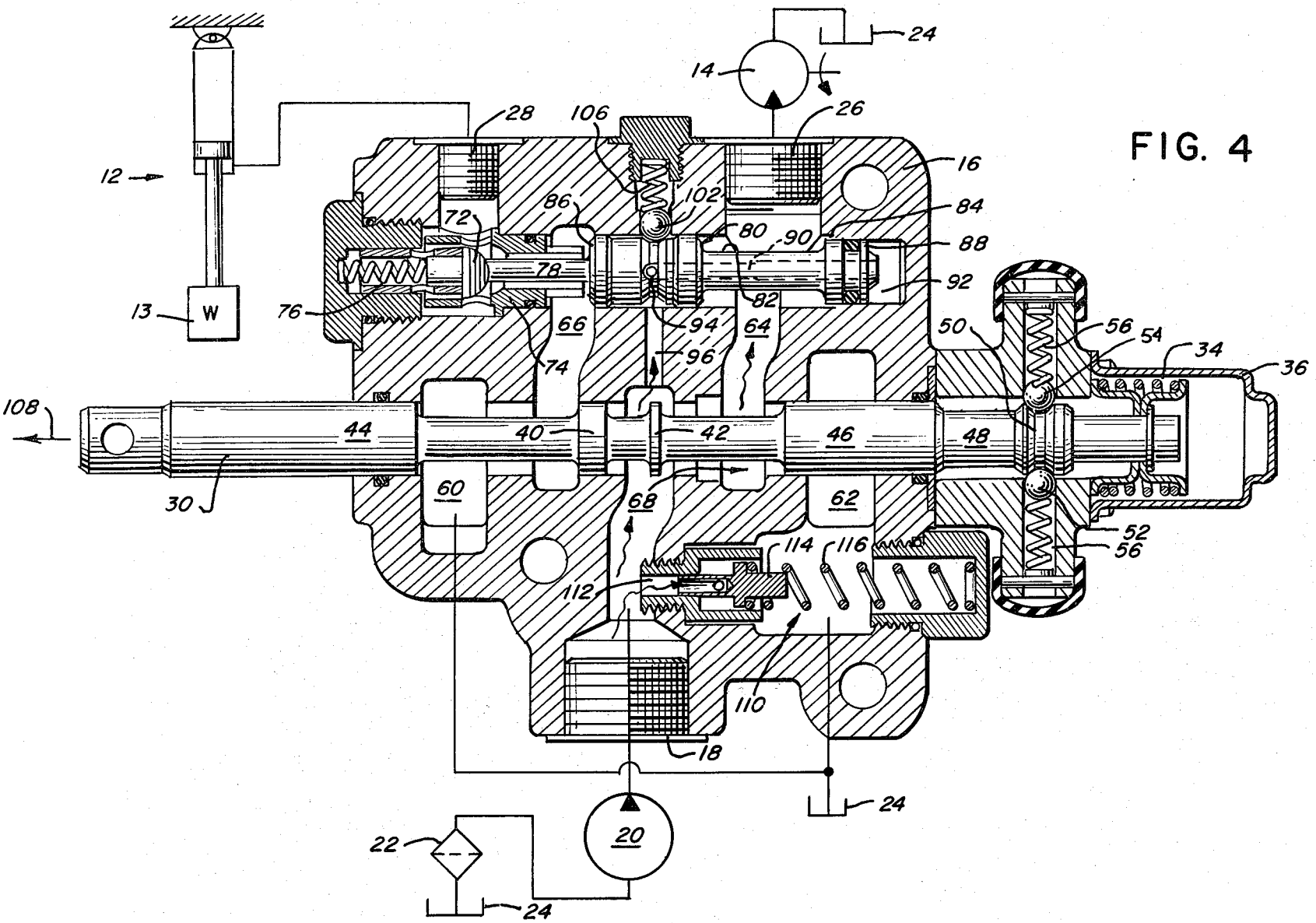
FIG. 4 is an illustration similar to FIG. 1 with the valve in the motor actuation and work member float position.

In this position of the pilot spool 80, once the reels 13 have been lowered to the desired position, the spool 30 may be again shifted in a leftward direction as indicated by the arrow 108 (FIG. 4). In this position land 40 is located within the bore 32, however, the land 42 is positioned within the core 68. Accordingly, pressurized fluid may flow through the core 68 along the bore 32 to the core 64. Thereafter, the pressurized fluid is introduced to the motor 14 driving the reels. At the same time land 40 prevents the introduction of pressurized fluid to the core 66 and since the spool 80 is held in the float position by the detent ball 102, the reels 13 are allowed to "float" over the contour of the green. In addition the detent balls 52 and 54 engage the reduced portion 50 of the main spool 30 holding the main spool 30 in this position. Consequently, the operator may release the main spool 30 and the vehicle will continue to operate in the desired mode.

Upon completion of mowing the green, the reel 13 may be raised by moving the main spool 30 to the position illustrated in FIG. 2. In this position, pressurized fluid is again introduced to core 66 interacting against end 86. The resultant force is sufficient to overcome the bias of the detent ball 102 shifting the pilot spool 80 to the position illustrated in FIG. 2. The pressurized fluid is also sufficient to bias the poppet valve 72 out of its seat 74 allowing pressurized fluid to flow out the outlet 28 to the cylinder 12 thus raising the reels 13.

To prevent damage to the valve 10 or other components of the system due to undesirable pressures within the housing 16, a relief valve generally designated by the reference numeral 110 is included. The relief valve 110 includes a passage 112 in fluid communication with the core 68 and with the core 62 and thus the tank 24 across a valve element 114. The valve element 114 is biased into sealing engagement with the passage 112 by a spring 116. Once sufficient pressure of a predetermined magnitude develops within the core 68, this pressure moves the valve element 114 out of sealing engagement with the passage 112 (FIG. 4) allowing fluid flow to bypass the remaining part of the valve 10 thereby preventing damage to the valve 10 due to pressure.

While the invention has been described with reference to details of the illustrated embodiment, it should be understood that such details are not intended to limit the scope of the invention as defined in the following claims.

What is claimed and desired to be secured by Letters Patent of the United States is:

1. A valve for directing fluid from a pressurized fluid source to a fluid operated motor and to a fluid actuated work member comprising:

a housing;

an inlet port in fluid communication with said source;

a first outlet port in fluid communication with said work member;

a second outlet port in fluid communication with said motor;

first passage means for communicating said inlet port with said first and second outlet ports;

means mounted in said first passage means for selectively directing fluid from said inlet port to one of said first and second outlet ports in response to operation of said fluid directing means;

said second outlet port being unobstructed, means for controlling fluid flow through said first outlet port, said controlling means including a pilot operated member positioned in a bore in said housing, said pilot operated member including means for interacting with said fluid to develop a force for actuating said pilot operated member to open said controlling means and for deactuating said pilot operated member to close said controlling means; said interacting means comprising first and second surfaces defined on said pilot operated member and being of different cross sectional areas and;

second passage means for communicating said bore with said fluid, and third passage means defined in said pilot operated member for communicating said fluid communicated to said bore to said first surface for actuating said pilot operated member, wherein said first surface is in fluid communication with said second passage means and said second surface is in fluid communication with said first outlet port.

2. The valve claimed in claim 1 further comprising means for releasably holding said pilot operated member in a first position allowing fluid flow through said first outlet port.

3. The valve claimed in claim 1 wherein said controlling means further comprises a valve seat defined in said first outlet port and a valve element adapted to seat in said valve seat, said valve element being coupled to said pilot operated member, said valve element's position relative to said valve seat being controlled by said pilot operated member.

4. The valve claimed in claim 1 further comprising means for relieving pressure in said housing.

5. A device for selectively regulating fluid flow to a fluid motor and a fluid actuated work member comprising:

a housing including an inlet port adapted to be coupled to a source of pressurized fluid, said housing further including a first outlet port adapted to be coupled to said work member and a second outlet port adapted to be coupled to said motor;

means for selectively directing said fluid from said inlet port to said work member and to said motor in response to operation of said fluid directing means said directing means including means for communicating said inlet port with said first and second outlet ports; and fluid pressure actuated means for controlling the flow of said fluid from said directing means to said first outlet, said pressure actuated means including a valve element and a valve seat disposed adjacent said first outlet, said valve element adapted to prevent fluid flow through said first outlet upon engagement with said seat, a valve element actuation member slidably mounted in said housing for controlling the engagement of said valve element with said seat, said actuation member having first and second fluid pressure surfaces of different cross sectional areas in fluid communication with fluid controlled by said fluid directing means through said communication means and means for releasably retaining said actuation member in a first position maintaining said valve element out of said seat, said retaining means comprising a detent mechanism for engaging said actuation member, said actuation member being actuated into said first position by fluid acting on said first fluid surface and said actuation member being released from said retaining means by fluid acting on said second fluid surface, said communicating means further communicating said inlet port with said first fluid surface, said second fluid surface being in fluid communication with said first outlet port.

6. The device set forth in claim 5 further comprising a pressure relief apparatus mounted in said housing and in pressure communication with said inlet.

7. A valve for selectively directing pressurized fluid to a fluid utilization device thereby actuating said device in a predetermined manner and to a fluid motor to operate said motor, said valve comprising:

a valve housing;

said housing including a first bore, a single inlet in fluid communication with a source of pressurized fluid, a passage communicating said inlet with said first bore, a first port in fluid communication with said utilization device, and a second port in fluid communication with said motor;

passage means for selectively communicating said first bore with said first and second ports, a fluid direction control member slidably mounted in said first bore and selectively adapted to control fluid flow through said passage means to said first and second ports in response to operation of said control member;

means for controlling fluid flow through said first port, said controlling means operable from a first position preventing flow through said first port to a second position allowing flow through said first port;

a single pilot fluid operated actuation member slidably mounted in said housing in a second bore in communication with said passage means for actuating said controlling means from said first position to said second position and from said second position to said first position, said actuation member including means for developing a force to operate said actuation member, second passage means for communicating said first bore with said second bore, third passage means in said actuation member for communicating said fluid in said second bore to said force developing means, and a detent assembly for releasably holding said actuation member in a position holding said controlling means in said second position and releasing said actuation member in response to force developed by said force developing means to return said controlling means to said first position, wherein said force developing means is responsive to fluid flow through said passage means and said second passage means.

8. The valve set forth in claim 7 wherein said pilot fluid actuated member comprises a piston, and said force developing means includes first and second surfaces defined on said piston, said first and second surfaces adapted to interact with said pressurized fluid to develop a force proportional to the area of each said surface, said first and second surfaces being of different areas.

9. The valve set forth in claim 7 further comprising a pressure relief device in fluid communication with said inlet.

* * * * *

UNITED STATES PATENT AND TRADEMARK OFFICE

CERTIFICATE OF CORRECTION

PATENT NO. : 4,170,246

DATED : October 9, 1979

INVENTOR(S) : Gary Johnson

It is certified that error appears in the above–identified patent and that said Letters Patent are hereby corrected as shown below:

In claim 7, column 6 at line 67 should read as follows:

passage means for communicating said

Signed and Sealed this

*First* Day of *January 1980*

[SEAL]

*Attest:*

SIDNEY A. DIAMOND

*Attesting Officer*

*Commissioner of Patents and Trademarks*